United States Patent [19]

Stotz et al.

[11] 4,443,112

[45] Apr. 17, 1984

[54] PLANETARY GEAR FOR DATE MECHANISM IN A WRISTWATCH

[75] Inventors: Gerhard Stotz, Pforzheim; Adolf Sedlak, Wurmberg, both of Fed. Rep. of Germany; Jean-Pierre Skwarek, Besancon, France

[73] Assignee: Timex Corporation, Waterbury, Conn.

[21] Appl. No.: 427,055

[22] Filed: Sep. 29, 1982

[51] Int. Cl.[3] ..... G04B 19/24

[52] U.S. Cl. ..... 368/37; 368/34

[58] Field of Search ..... 368/185, 187, 60, 77, 368/40, 80, 51, 63, 28, 31, 34–36

[56] References Cited

U.S. PATENT DOCUMENTS

| | | | |
|---|---|---|---|
| 3,645,090 | 2/1972 | Mochizuki et al. | 368/32 |
| 3,722,207 | 3/1973 | Challandes | 368/27 |
| 3,930,131 | 12/1975 | Nishina | 368/97 |
| 4,259,735 | 3/1981 | Vuille | 368/34 |

*Primary Examiner*—Bernard Roskoski

*Attorney, Agent, or Firm*—William C. Crutcher

[57] ABSTRACT

A wristwatch with a stepping motor driving the hands through a normal gear train also includes a supplementary gear train driving a circumferential date ring showing the calendar date. The gear train includes a planetary gear assembly, which may also be selectively operated by an exterior manually rotatable button to change the date without interfering with the normal driving of the date ring from the stepping motor. Preferably the manually rotatable button is operable from the back of the watch using a ball-point pen or the like.

10 Claims, 5 Drawing Figures

PLANETARY GEAR FOR DATE MECHANISM IN A WRISTWATCH

BACKGROUND OF THE INVENTION

This invention relates generally to a wristwatch with hands and calendar date ring driven by the watch motor. More particularly, it relates to an improved mechanism for manually changing the date without interfering with the normal timekeeping or date advancing functions of the watch.

Calendar watches are well known in the art which, in addition to normal time indicating hands, include a circumferential ring of numbers showing the calendar date. Such watches usually require manual adjustment of the displayed date for months having fewer than 31 days. Illustrative of the prior art are the following patents which are exemplary, but not intended to be all inclusive:

| Pat. No. | Issue Date | Patentee |
|---|---|---|
| 3,413,800 | 12/3/68 | G. Dubois et al. |
| 3,645,086 | 2/29/72 | E. Niznik |
| 3,716,983 | 2/20/73 | Tanaka et al. |
| 4,291,397 | 9/22/81 | Wuthrich et al. |

Such calendar watches, which include means to manually change the date indication, normally include an external actuator which may be operated to advance the date. Usually the date may be manually advanced, but not retarded or moved in the opposite direction.

One of the common problems with such systems is that, if there is an attempt to manually advance the date at the precise time when the normal timekeeping mechanism is also advancing the date, damage can result to the delicate internal mechanism of the watch. One effort to avoid such damage is illustrated in German Offenlegungschrift DE No. 3046569A1 in the names of Schwartz and Skwarek, laid open on July 15, 1982, and assigned to the present assignee.

The present invention incorporates a planetary gear. Planetary or epicyclic gears have previously been suggested in watches, for example in gearing driving the hands for normal timekeeping, as in U.S. Pat. No. 3,722,207 issued Mar. 27, 1973 to Challandes; U.S. Pat. No. 3,184,909 issued May 25, 1965 to Lohf et al.; and U.S. Pat. No. 4,254,493 issued Mar. 3, 1981 to A. Billet, the latter assigned to the present assignee. Planetary gears have also been suggested for the winding mechanism of mechanical watches by P. Wuthrich in U.S. Pat. No. 3,104,517 issued Sept. 24, 1963, assigned to the present assignee.

The advent of the quartz analog stepping motor watch has imposed more severe requirements upon the drive mechanism which advances the calendar date ring. Since the power to drive the ring is derived from a tiny stepping motor driven by electronic pulses from an integrated circuit, rather than from a spring motor, a drive mechanism which conserves battery life is essential. Also, there is an ever increasing tendency toward thinner and thinner watches, which nevertheless must continue to employ economic construction, simplicity of assembly, and fewer parts. Plastic materials for gear members offer many advantages in cost and in the ability to produce complex shapes.

Accordingly, one object of the present invention is to provide an improved calendar watch with means to adjust the date indication without disturbing the normal function of the watch or causing damage.

Another object of the invention is to provide an improved quartz analog stepping motor calendar watch which is thin and incorporates a manually adjustable calendar drive mechanism of low cost plastic parts.

Another object of the invention is to provide an improved calendar watch with a planetary gear mechanism for changing the date indication in either direction from outside the watch without damage.

DRAWING

The invention, both as to organization and method of practice, together with further objects and advantages thereof, will best be understood by reference to the following description, taken in connection with the accompanying drawings, in which:

FIG. 1 is an elevation drawing, partly in section, of a portion of a wristwatch illustrating the invention, FIG. 2 is a plan view of a portion of the watch shown in cross section in FIG. 1, FIGS. 3 and 4 are plan views of the exterior front and exterior rear of a watch respectively, and FIG. 5 is an elevation drawing, partly in section, of a modified form of the invention.

SUMMARY OF THE INVENTION

Briefly stated, in a watch with a motor driving hands through a normal timekeeping gear train, and also having a date ring advanced periodically by a supplementary gear train, the improvement comprising a planetary gear assembly forming a portion of the supplementary gear train, and a manually rotatable button accessible from outside of the watch operatively connected to the planetary gearing to independently advance or retard the date ring. Preferably the planetary gear assembly includes first and second coaxial gears, a planet gear rotatably mounted in a planet carrier and meshing with the first and second gears, the planet carrier being driven, the second gear advancing the date ring, and the first gear coupled to be driven by the rotatable button.

DESCRIPTION OF THE PREFERRED EMBODIMENT

Figure 1:
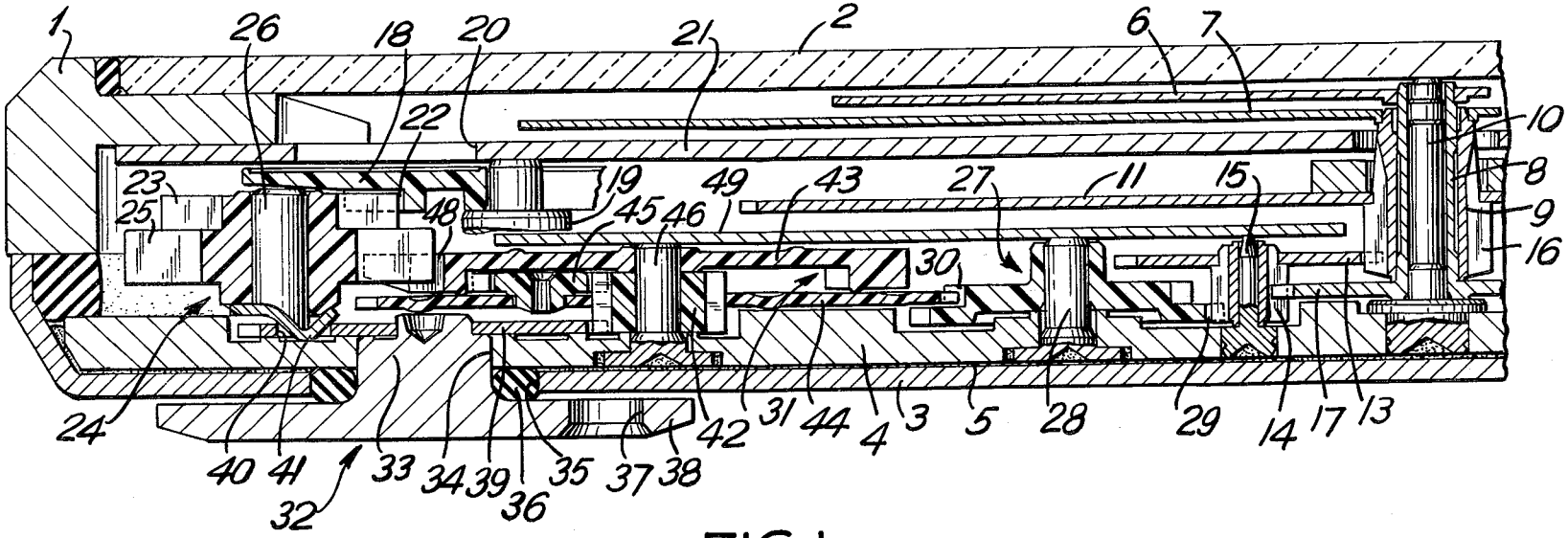
Figure 2:
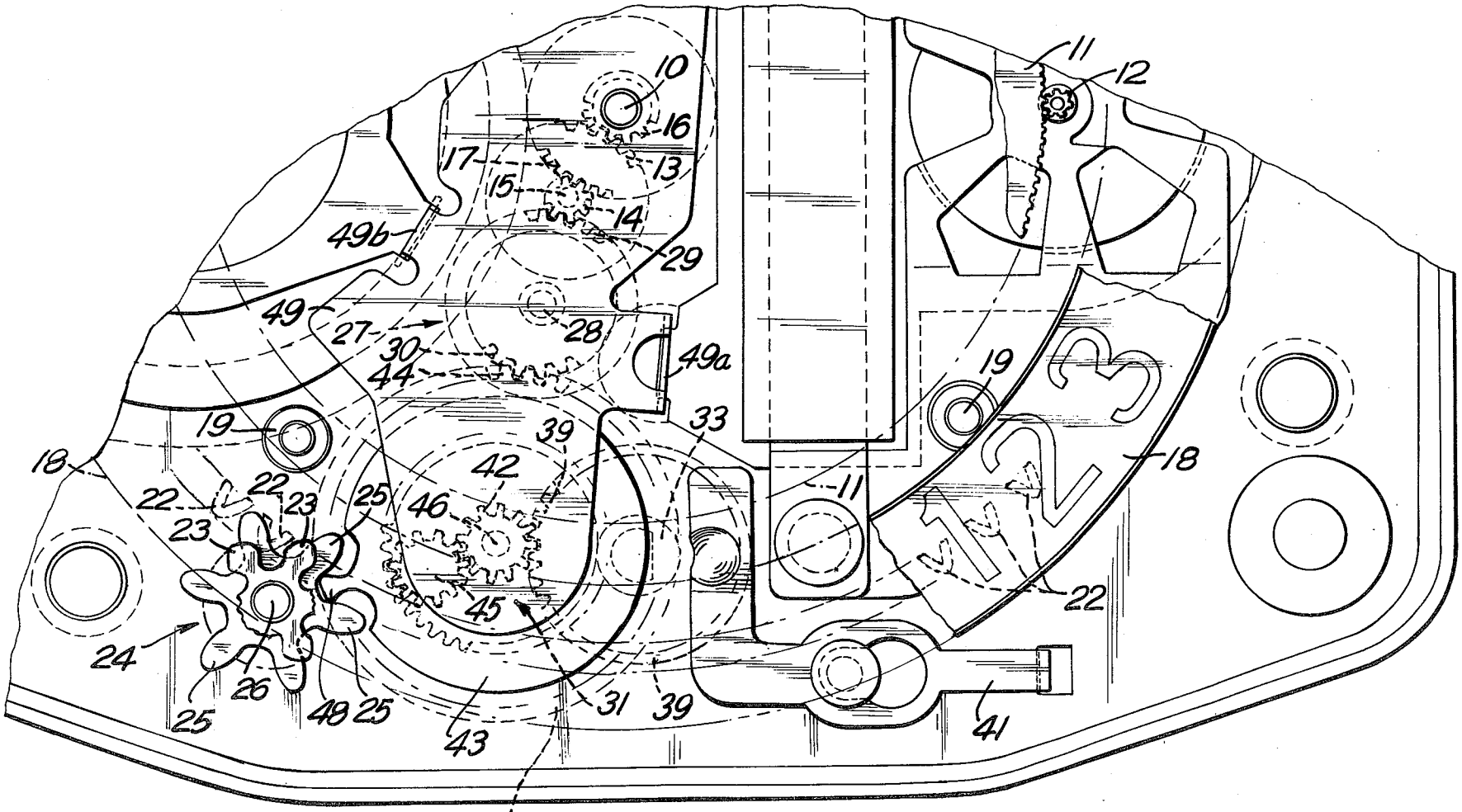

Referring now to FIG. 1 of the drawing, a thin quartz analog stepping motor calendar watch includes an outer housing comprising a bezel 1, a transparent lens or crystal 2, and a caseback 3, preferably of thin stainless steel adhered to an inner frame member 4 by means of adhesive 5. The normal timekeeping mechanism includes an hour hand 6 and minute hand 7 supported on coaxial sleeves 8, 9 respectively disposed around a fixed center post 10. Sleeve 9 is fixed to a center wheel 11, which is driven directly at the rim by a stepping motor pinion 12 (FIG. 2). The center wheel 11 and minute hand 7 are thereby driven together directly by the stepping motor in the manner previously shown and described in assignee's copending U.S. application, Ser. No. 258,061 filed Apr. 27, 1981 in the name of Paul Wuthrich, now U.S. Pat. No. 4,376,966 issued Mar. 15, 1983.

In order to rotate the hour hand at a reduced rate, a normal timekeeping gear train includes a minute wheel 13 attached to a minute pinion 14 rotatably mounted on a post 15 secured in the frame member 4. The minute wheel 13 meshes with teeth 16 on sleeve 9 and pinion 14 meshes with an hour wheel 17 attached to sleeve 8, thereby to provide a reduction and act as a normal gear train for timekeeping.

In order to indicate the date, the watch is provided with a circumferential date ring rotatably mounted around a number of circumferentially spaced fixed studs, such as 19. The date ring has date numerals printed on the upper surface thereof, which are viewable through a window 20 in a dial 21 in the conventional manner. The date ring has teeth 22 on its underside which mesh with a first set of teeth 23 on a date indexing pinion 24. Date indexing pinion is preferably molded of plastic material to include a second set of specially shaped teeth 25 and is rotatably mounted on a fixed post 26.

In order to periodically advance the date ring by rotating the date indexing pinion 24, a supplementary gear train is employed which is driven by the stepping motor via the minute pinion 14. The supplementary gear train includes an intermediate wheel and pinion shown generally at 27 rotatably mounted on a fixed post 28. The intermediate wheel and pinion is preferably made of plastic, with a first set of teeth 29 meshing with minute pinion 14 and a second set of teeth 30.

The elements previously described may be basically found in known calendar watch mechanisms. In accordance with the present invention, a planetary gear mechanism 31 forms a portion of the supplementary gear train and is interposed between intermediate wheel 27 and date indexing pinion 24 and adapted to periodically rotate the date indexing pinion 24. The planetary gear assembly 31 is also arranged to be actuated externally by means of a manually rotatable date button shown generally at 32. The date button is journaled on a stem 33 extending through a hole 34 in the frame member 4 and through a larger hole 35 in the caseback 3. A seal is provided by an O-ring gasket 36. An eccentric hole 37 in a circumferential flange 38 of the date button 32 provides means for rotating it using a stylus, ball-point pen or the like. A button date wheel 39 is locked to the inner end of the stem 33. The button date wheel 39 has teeth engaging with the planetary gear assembly 31 so as to rotate portions of it when the external date button is manually rotated. The button date wheel is detented and held in preferred positions by a detent spring 41.

Although the planetary gear mechanism may take several forms, in its preferred embodiment as shown in FIG. 1, it includes a first or "sun" gear 42, a second or "ring" gear 43, and a planet carrier 44 with a single "planet" pinion 45 rotatably mounted in the planet carrier. The first and second gears and the carrier 44 are all coaxially disposed and rotatably mounted on a fixed post 46. The planet carrier 44 has external teeth driven by teeth on the intermediate wheel 27. The first or sun gear has pinion teeth engaged with those on the button date wheel 39. The second ring gear 43 includes a single tooth 48 on its outer periphery which serves to advance the date indexing pinion 24 by two teeth upon each revolution. The second ring gear 43 has internal gear teeth meshing with those of the planet pinion 45, which also meshes with the first sun gear 42.

The first gear, second gear, planet carrier and planet gear are preferably all moulded of plastic material. Plastic gear members are comtemplated in the preferred form of the invention, because difficult gear shapes, may be easily moulded. Such shapes include the date indexing pinion 24, the intermediate wheel 27, the planetary outer gear 43 with internal teeth and a single advancing tooth 48. The date ring 18 may also advantageously be made of plastic, so that the entire supplementary gear train from intermediate wheel 27 to ring gear 18 may be of low cost construction. In order to hold all of the aforesaid gear members in place and to control "endshake" or axial movement of the gears on the fixed posts, a spring clamp 49 is secured to the frame 4, as indicated at **49*a* and 49*b*** by retaining tabs. A similar arrangement for controlling endshake is previously described fully in assignee's copending U.S. application Ser. No. 275,469 filed June 19, 1981 in the names of Rinaldi and Wuthrich.

Figure 3:
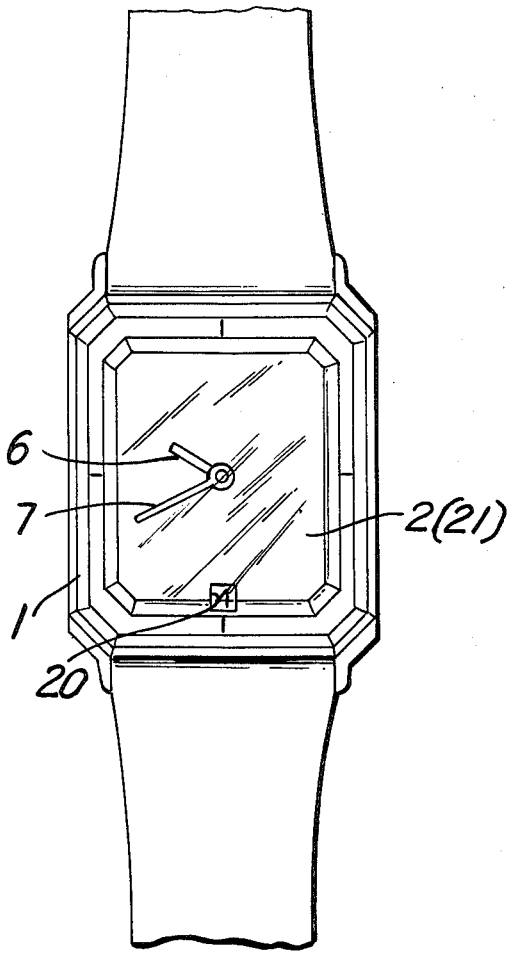
Figure 4:
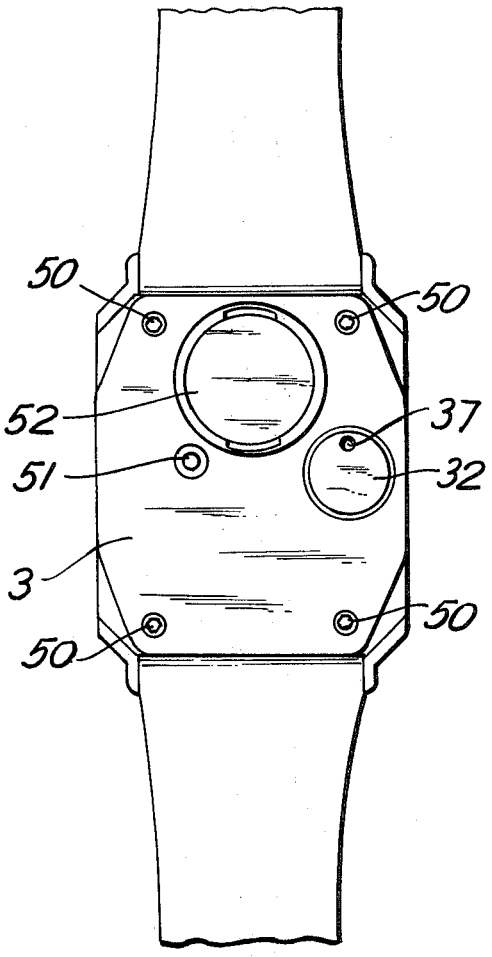

The front side and back side of a typical watch using the invention further illustrate the invention. The front view shown in FIG. 3 is typical of a calendar watch with the date window 20 being located at the 6:00 o'clock position. The back view in FIG. 4 shows that the caseback 3 is secured to the bezel by means of screws 50 in each corner while a recessed push button 51 may be used to set the hands. A cover 52 allows access to an energy cell. The manually rotatable date button 32 with small eccentric hole 37 to rotate it with a stylus or ball-point pen or the like is seen to be accessible from the rear of the watch.

MODIFICATION

Figure 5:
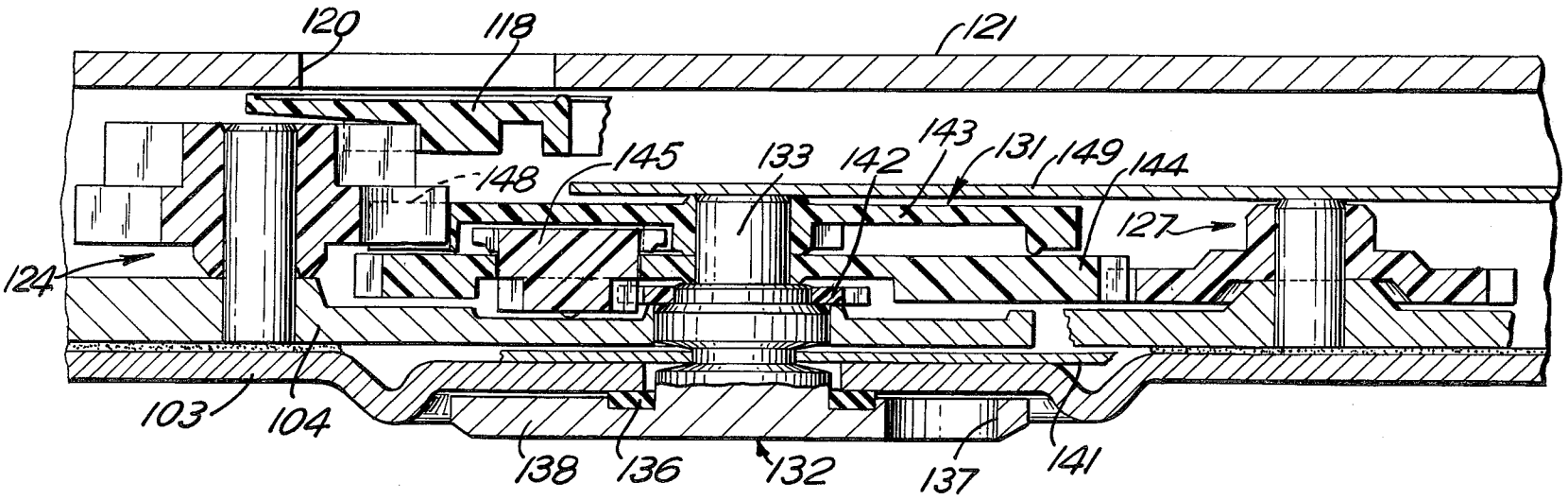

FIG. 5 is an elevation drawing of a modified form of the invention. In this arrangement, the date button and the first gear are both disposed on a common axis rather than disposed on two axes and geared together. A date ring 118 is located beneath a viewing hole 120 in a dial 121, and driven by a date indexing pinion 124 as before. The date ring is periodically advanced by a supplementary gear assembly train comprising an intermediate wheel 127 and a planetary gear shown generally at 131. The watch case is constructed as before with a thin caseback 103 and frame member 104 laminated thereto with adhesive. An external manually rotatable date button 132 with flange 138 and sealing gasket 136 has a stem 133 projecting into the watch case.

A first or lower gear 142 is keyed to the stem to rotate therewith and mesh a first set of teeth on a planet gear 145. Planet 145 is rotatably mounted in a planet carrier 144, which in turn is rotatably disposed around the stem 133. The planet 145 also has a second set of teeth meshing with the teeth of a second or upper gear 143. Gear 143 also has thereon a single tooth 148, which once each revolution serves to advance the date indexing pinion 124. The gear members of the supplementary gear train are held in place by a spring clamp 149, similar to spring clamp 49 previously described.

OPERATION

The operation of the preferred embodiment of the invention shown in FIGS. 1 and 2 is as follows.

During normal advancing of the date ring 18, the minute pinion 14 drives intermediate pinion 27, which in turn drives the planet carrier 44 by less than one turn per day (depending on the transmission). The first or sun gear 42 is locked in place by meshing with the button date wheel 39, held by detent spring 41. The planet gear 45 therefore travels around the sun gear 42 as the planet carrier 44 rotates, being driven by the locked sun gear 42. The planet gear drives the second or ring gear 43 once per day. The single tooth 48 of the ring gear turns the date index pinion 24 once per day at midnight by two teeth, which advances the date ring 18 by one step.

During the manual date setting function, date button 32 is rotated using a ball-point pen in the eccentric hole 37 of the date button. Either direction of rotation (advance or reverse) is possible. The date button 32 rotates the date button wheel 39 and the sun gear 42. The planet carrier 44 is for all practical purposes locked by the gear train friction of the intermediate wheel 27 and other gear train members. The sun gear 42 rotates the planet pinion 45 around its axis in the fixed planet carrier 44, thereby driving the outer gear 43 once for one complete rotation of the date button 32. The single tooth 48 of the ring gear 43 turns the date indexing pinion 24 by two teeth per revolution, which advances or reverses the date ring 18 by one step.

The operation of the modification shown in FIG. 5 is similar. However due to the fact that the first or lower gear 142 is directly mounted to the date button, and the fact that the teeth on the second or upper gear 143 are located on the inner circumference and since there are different gear ratios, it is necessary to turn the date button 132 only one half revolution to advance the date by one step. The modification shown in FIG. 5 is somewhat more difficult to assemble and has less favorable gear ratios than the preferred embodiment.

The advantages of the foregoing construction are that the date can be set in either direction, and it can also be set during time when the date ring is being advanced through the supplementary gear train by the stepping motor. Nothing can be damaged and the setting mechanism remains functional during all 24 hours of the day. The planetary mechanism provides great saving of space for the necessary gear ratio reduction and is designed for a simple assembly of parts. Most of the necessary parts can be made of plastic, seven gear members in the preferred embodiment and six gear members in the modified form of the invention.

While there has been disclosed what is considered herein to be the preferred embodiment of the invention, and one modification thereof, other modifications will occur to those skilled in the art, and it is desired to include in the appended claims all such modifications as fall within the true spirit and scope of the invention.

We claim:

1. An improved date setting mechanism in a watch of the type having a normal timekeeping gear train for driving watch hands from a motor, and also having a supplementary gear train for periodically advancing a date ring, wherein said improvement comprises:

a planetary gear assembly making up a portion of the supplementary gear train, having a first gear, a coaxial second gear, a planet carrier coaxial with said first and second gears, said carrier having teeth driven as part of said supplementary gear train, and at least one planet gear rotatably mounted in the carrier member and meshing with the first and second gears, the second gear adapted to periodically advance means driving the date ring, and a manually rotatable date button accessible from the outside of the watch and coupled to drive the first gear, whereby the first gear may drive the second gear through the planet gear to advance or retard the date ring without disturbing the normal date advancing function.

2. The improvement according to claim 1, and further including spring detent means adapted to hold the date button in preferential detented positions.

3. The improvement according to claim 1, wherein the supplementary gear train, including the planetary gear assembly comprises members molded of plastic material.

4. The improvement according to claim 1, wherein said means driving the date ring comprises a date indexing pinion coupled to the date ring, and wherein said second gear member includes a single date advancing tooth periodically engaging said date indexing pinion.

5. The improvement according to claim 1, wherein said date button is affixed to a date button wheel inside the watch which is coupled to drive said first gear.

6. The improvement according to claim 1, wherein said date button includes a stem with said first gear fixedly mounted thereon.

7. The improvement according to claim 1, wherein said first gear comprises a sun gear, wherein said second gear comprises a ring gear with internal teeth, and wherein said planet carrier comprises a wheel disposed around the first gear and having a planet gear eccentrically mounted therein meshing between the first gear teeth and the second gear internal teeth.

8. The combination according to claim 1, wherein said supplementary gear train includes an intermediate wheel driving the planetary gear assembly, and a date indexing pinion coupled to the date wheel driven by the planetary gear assembly, said driving and driven gears being molded of plastic and rotatably disposed on fixed posts in the watch case.

9. The improvement according to claim 1, wherein said first and second gears have external teeth, and wherein said planet gear has two sets of teeth meshing with those of the first and second gears respectively, and wherein the date button and the first and second gears are coaxially disposed on a single axis of rotation.

10. The improvement according to claim 1, wherein said date button has a circumferential flange accessible outside the watch, with an eccentric hole therein for manually rotating the date button using a stylus, ballpoint pen, or the like.

* * * * *